US005404941A

United States Patent [19]

Jacksits

[11] Patent Number: 5,404,941

[45] Date of Patent: Apr. 11, 1995

[54] SPLIT RING TUBE SPACER ASSEMBLY

[75] Inventor: Raymond J. Jacksits, Norton, Ohio

[73] Assignee: The Babcock & Wilcox Company, New Orleans, La.

[21] Appl. No.: 104,972

[22] Filed: Aug. 10, 1993

[51] Int. Cl.[6] ..... F28F 9/013

[52] U.S. Cl. ..... 165/162; 165/172; 122/510

[58] Field of Search ..... 165/172; 11/162; 122/510

[56] References Cited

U.S. PATENT DOCUMENTS

| | | | |
|---|---|---|---|
| 3,595,309 | 7/1971 | Hawkins | 165/162 |
| 4,013,024 | 3/1977 | Kochey, Jr. et al. | 165/162 X |
| 4,030,540 | 6/1977 | Roma | 165/172 |
| 4,286,654 | 9/1981 | Ruhe et al. | 165/172 |
| 5,083,372 | 1/1992 | Polutnik et al. | 29/890.043 |

*Primary Examiner*—John Rivell
*Assistant Examiner*—L. R. Leo
*Attorney, Agent, or Firm*—Daniel S. Kalka; Robert J. Edwards

[57] ABSTRACT

A spacer for aligning a series of tubes comprises a first side having a plurality of adjacently positioned recesses and an extended portion projecting the adjacent recesses. The spacer also comprises a second side having a plurality of adjacently positioned recesses and a projection between the adjacent recesses. The first side and the second side are oppositely aligned around a series of tubes such that each tube is positioned between a recess of the first side and a recess of the second side and the extended portion of the first side extends near the projection of the second side for defining a weld area. A weld is also provided at the weld area for fixing the extended portion of the first side to the projection of the second side.

2 Claims, 3 Drawing Sheets

SPLIT RING TUBE SPACER ASSEMBLY

BACKGROUND OF THE INVENTION

1. Field of the Invention

The present invention relates in general to power plant tubes and, in particular, to a new and useful spacer for aligning a series of tubes.

2. Description of the Related Art

In the power plant field, there are several known devices and methods which are used for clamping a series of boiler tubes. One known device uses two bar halves wherein each bar half comprises a plurality of recesses which are aligned and adjoined around a plurality of boiler tubes. The bar halves have aligned apertures for receiving a bolt, which is in turn, secured to a backing plate at one side of one of the bar halves.

A second known device uses bar halves which are a split ring casting having pins and holes. The pins of one bar half are fitted and aligned in the holes of a second bar half.

U.S. Pat. No. 5,083,372 to Polutnik, et al. also discloses a device for clamping tubes in parallel having two bar halves which are aligned and bolted to each other.

Presently, there is no known device or method for aligning and clamping a series of boiler tubes which is simple in design, rugged in construction and cost-efficient.

SUMMARY OF THE INVENTION

The present invention is a spacer for aligning a series of tubes comprising a first side having a plurality of adjacently positioned recesses and an extended portion between the adjacent recesses. The spacer also comprises a second side having a plurality of adjacently positioned recesses and a projection between the adjacent recesses. The first side and the second side are oppositely aligned around a series of tubes wherein each tube is positioned between a recess of the first side and a recess of the second side and the extended portion of the first side extends near the projection of the second side for defining a weld area. A weld is also provided at the weld area for fixing the extended portion of the first side to the projection of the second side. Thus, the present invention provides a spacer assembly which utilizes a split ring.

According to the present invention, the first side has a width which is greater than the width of the second side for facilitating welding.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which a preferred embodiment of the invention is illustrated.

DESCRIPTION OF THE PREFERRED EMBODIMENTS

Figure 2:
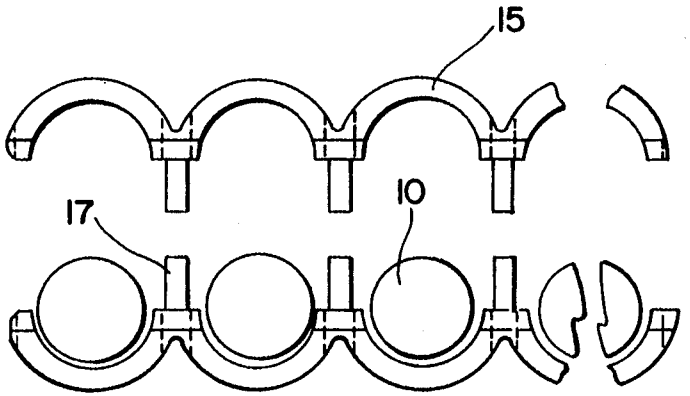
FIG. 2 PRIOR ART
FIG. 2 is a top view of the connector of FIG. 1.
Figure 1:
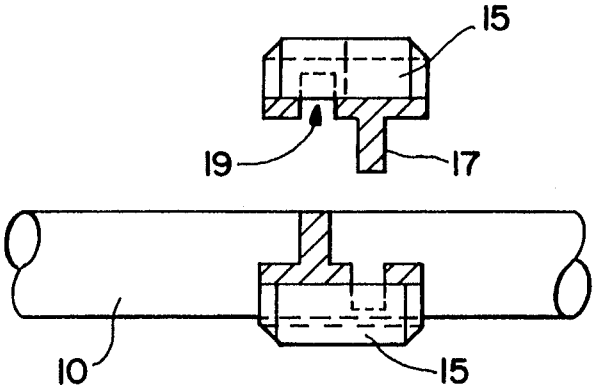
FIG. 1 PRIOR ART
FIG. 1 is a view illustrating a section of a known connector for aligning tubes.
Figure 3:
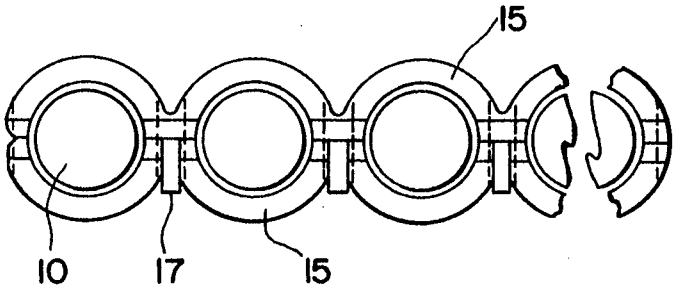
FIG. 3 PRIOR ART
FIG. 3 is a view of FIG. 2 after alignment.

As shown in FIGS. 1–3, known spacers comprise two bar halves 15 wherein each bar half 15 comprises a pin 17 and an adjacently positioned hole 19. Each bar half 15 is fitted around a tube 10 such that the pin 17 of one bar half 15 is fitted in the hole 19 of the second bar half 15 and vice-versa. As illustrated in FIG. 2, a series of tubes 10 are positioned within this pin and hole arrangement as described above.

Figure 4:
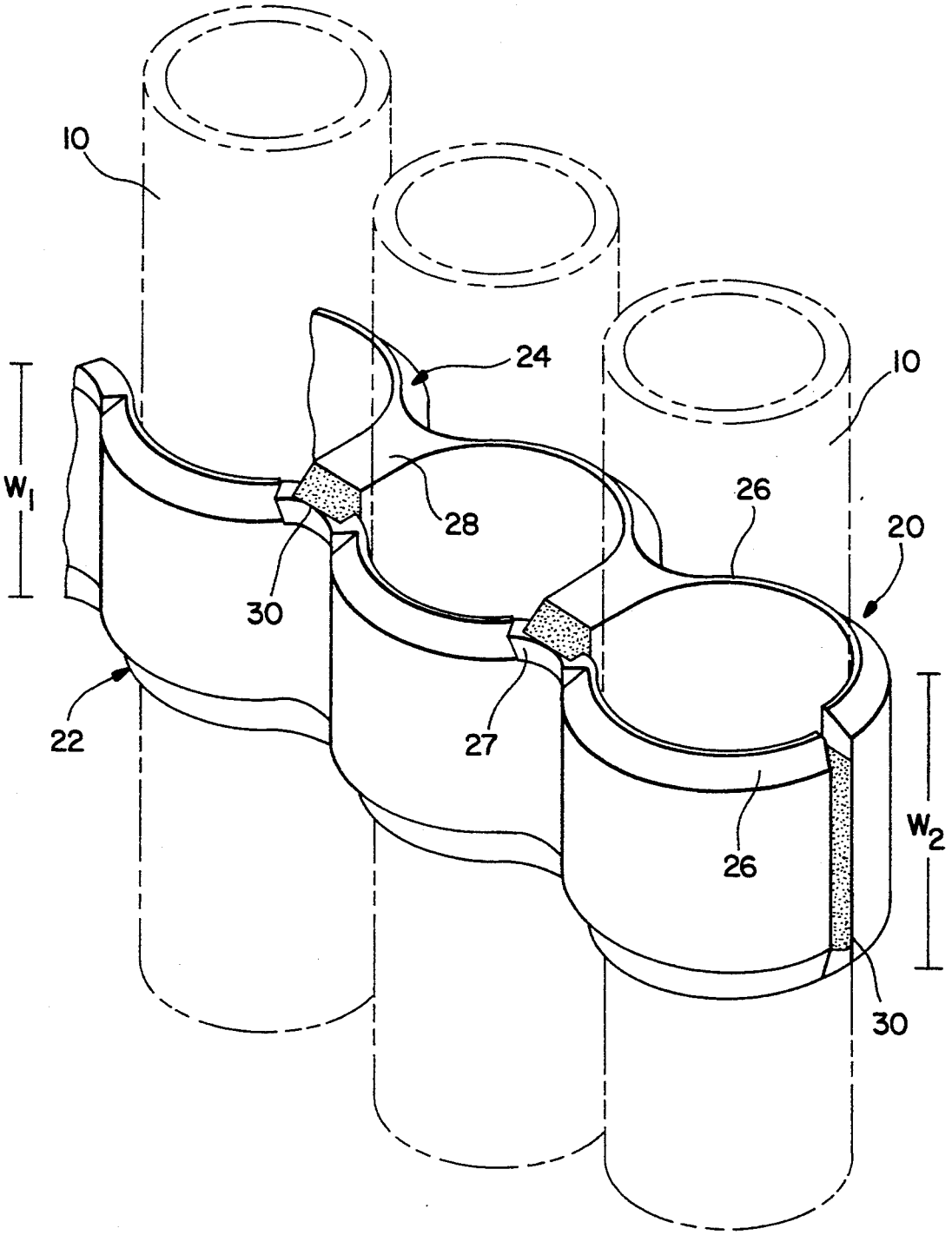
FIG. 4 is a perspective view of the present invention.

The present invention provides a tube spacer which is a split ring assembly, generally designated 20, as shown in FIG. 4, which is used to maintain the back spacing of the tubes 10 for facilitating the alignment and spacing between each tube 10. The split ring assembly 20 comprises a first side 22, which is one-half of the split ring assembly 20 and having a plurality of adjacently positioned recess portions 26. A plurality of protrusions 27 are formed between each recess portion 26 of the first half 22. The first half 22 of the split ring assembly 20 is aligned on one side of a series of tubes 10.

The split ring assembly 20 also comprises a second half 24 having a plurality of adjacent recess portions 26 which are aligned with the recess portions 26 of the first half 22 of the split ring assembly 20. Extended portions 28 are provided between the adjacently positioned recess portions 26 of the second half 24 of the split ring assembly. The extended portions 28 of the second half 24 extend between the tubes 10 and are positioned near the protrusions 27 of the first half 22. Thus, the recess portions 26 of both the first half 22 and the second half 24 are aligned opposite each other for maintaining and spacing the series of tubes 10 within. The second half 24 has a width W2 which is greater than a width W1 for the first half 22 in order to provide a more efficient welding of the split ring assembly 20. Welds 30 are provided at each extended portion 28 and protrusion 27 for securing the extended portion 28 to the protrusion 27. Welds 30 are also provided at end points of the split ring assembly 20 as shown in FIG. 4.

Figure 5:
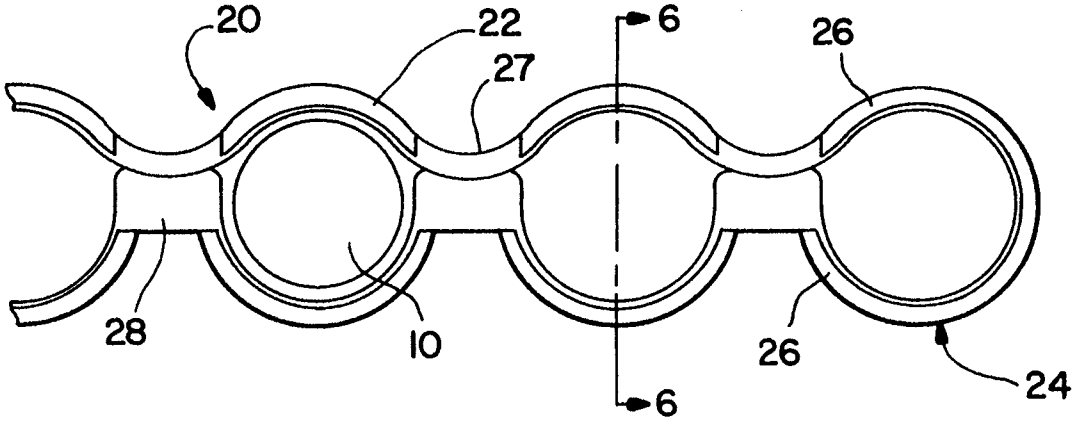
FIG. 5 is a top view of the present invention.
Figure 6:
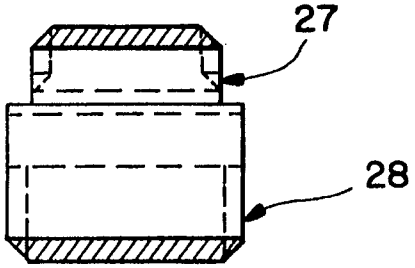
FIG. 6 is a view of FIG. 5 taken along line 6—6.

As illustrated in FIGS. 5 and 6, the extended portion 28 of the second half 24 of the split ring assembly 20 extends over the protrusion 27 which forms an overlap which facilitates the welding of the split ring assembly 20.

While specific embodiments of the invention have been shown and described in detail to illustrate the application of the principles of the invention, it will be understood that the invention may be embodied otherwise without departing from such principles.

What is claimed is:

1. A spacer for aligning a series of tubes, the spacer comprising:

a first side having a plurality of adjacently positioned recesses and an extended portion projecting between the adjacent recesses of the first side, the first side having a first width;

a second side having a plurality of adjacently positioned recesses and a projection between the adjacent recesses of the second side, the second side having a second width, the first width of the first side being greater than the second width, the first and second sides being oppositely aligned around a series of tubes, each tube being positioned between a recess of the first side and a recess of the second side, the extended portion of the first side extending between the tubes and near the projection of the second side for defining a weld area, the extended portion of the first side extending over the projection of the second side to form an overlap which facilitates welding; and a weld at the weld area for fixing the extended portion of the first side to the projection of the second side.

2. The spacer according to claim 1, wherein the weld comprises an overlap of the first side and the second side.

* * * * *